US008297995B2

(12) United States Patent
Payan

(10) Patent No.: US 8,297,995 B2
(45) Date of Patent: Oct. 30, 2012

(54) DEVICE FOR PREVENTING THE ESTABLISHMENT OF AN ELECTRIC ARC BETWEEN TWO CONDUCTIVE ELEMENTS

(75) Inventor: Denis Payan, Mervilla (FR)

(73) Assignee: Centre National d'Etudes Spatiales, Paris (FR)

( * ) Notice: Subject to any disclaimer, the term of this patent is extended or adjusted under 35 U.S.C. 154(b) by 0 days.

(21) Appl. No.: 12/736,220

(22) PCT Filed: Mar. 16, 2009

(86) PCT No.: PCT/FR2009/050426

§ 371 (c)(1), (2), (4) Date: Dec. 6, 2010

(87) PCT Pub. No.: WO2009/122076

PCT Pub. Date: Oct. 8, 2009

(65) Prior Publication Data

US 2011/0097916 A1 Apr. 28, 2011

(30) Foreign Application Priority Data

Mar. 21, 2008 (FR) ..... 08 51841

(51) Int. Cl.
*H01R 13/53* (2006.01)

(52) U.S. Cl. ..... 439/186

(58) Field of Classification Search ..... 439/271–279, 439/181, 186

See application file for complete search history.

(56) References Cited

U.S. PATENT DOCUMENTS

| | | | | |
|---|---|---|---|---|
| 3,774,141 | A * | 11/1973 | Condon | 439/730 |
| 4,126,371 | A | 11/1978 | Puhak | |
| 4,468,083 | A | 8/1984 | Lee et al. | |
| 4,559,973 | A | 12/1985 | Hane et al. | |
| 4,675,779 | A * | 6/1987 | Neuwirth | 361/119 |
| 6,345,997 | B1 | 2/2002 | Shon | |
| 7,632,141 | B2 * | 12/2009 | Malak | 439/578 |
| 2001/0027047 | A1 * | 10/2001 | Miwa | 439/272 |
| 2002/0132526 | A1 | 9/2002 | Bae et al. | |
| 2006/0063412 | A1 * | 3/2006 | Matsumoto et al. | 439/274 |

FOREIGN PATENT DOCUMENTS

| | | |
|---|---|---|
| EP | 1 289 064 | 3/2003 |
| FR | 2 772 992 | 6/1999 |
| GB | 1 334 969 | 10/1973 |
| GB | 2 310 549 | 8/1997 |
| WO | WO 2007/130811 | 11/2007 |

* cited by examiner

*Primary Examiner* — Ross Gushi

(74) *Attorney, Agent, or Firm* — Jacobson Holman PLLC

(57) ABSTRACT

The invention relates to a device for preventing the establishment of an electric arc between two adjacent parts, which have no electrical insulation, of at least two electrically conductive elements, comprising at least one piece made of a dielectric material, said device having at least one through-opening for receiving at least one of said at least two electrically conductive elements so as to surround at least one of said at least two adjacent parts, which have no electrical insulation, of said at least two electrically conductive elements.

20 Claims, 3 Drawing Sheets

DEVICE FOR PREVENTING THE ESTABLISHMENT OF AN ELECTRIC ARC BETWEEN TWO CONDUCTIVE ELEMENTS

This is a national stage of PCT/FR09/050426 filed Mar. 16, 2009 and published in French, which has a priority of French no. 08 51841 filed Mar. 21, 2008, hereby incorporated by reference.

The present invention relates to a device for preventing the establishment of an electric arc between two adjacent parts, which have no electrical insulation, of at least two electrically conductive elements, for example between the mutually facing conductive elements which protrude from the surface of a connector body.

The invention has a particular application in the electrical or electronic components, such as connectors, employed in a space environment or under conditions reproducing such an environment. It should, however, be understood that the invention applies in general to the electrical or electronic components intended to be employed in any environment in which an electric arc is capable of being formed between two mutually facing conductive elements.

The electrical or electronic components employed in a space environment are often damaged because of the establishment of one or more electric arcs between the conductive elements which they comprise. These conductive elements may, for example, be pins belonging to a male connector and insertable into a female connector, or the ends of cores of conductive wires which are stripped over about 1 mm and soldered or crimped into conductive metal tubes connected to the pins.

Such conductive elements are arranged facing one another, in particular mutually parallel, and are separated by air or vacuum gaps.

In a terrestrial environment where air constitutes an insulator under normal conditions of temperature and pressure, the problem of avoiding the establishment of electric arcs between the stripped parts of the conductive elements of the connectors does not generally arise, air being an insulator except in the event of an intense electric field or high humidity.

In a space environment without an atmosphere, a precursor phenomenon (filament, dust, ESD, high voltage, etc.) is capable of generating a local plasma between the stripped parts of two conductive elements. This, by relaxing, will make the medium conductive and establish a short circuit between the two conductive elements. In air, an intense electric field may give rise to the generation of such a plasma.

It is therefore an object of the invention to prevent the formation, or at least the establishment, of these arcs between two electrically conductive elements.

To this end, the invention provides a device for preventing the establishment of an electric arc between two adjacent parts, which do not have electrical insulation, of at least two electrically conductive elements, comprising at least one piece which is made of a dielectric material and has at least one through-opening for receiving at least one of said at least two electrically conductive elements so as to surround at least one of said at least two adjacent parts, which do not have electrical insulation, of said at least two electrically conductive elements.

The device is noteworthy in that the dielectric material from which the piece is made is deformable or compressible.

When produced in this way, the device prevents the electrically conductive parts stripped of electrical insulation from facing one another directly, by at least partially filling the space between the conductive elements. The fact that the dielectric material from which the piece is made is sufficiently deformable or compressible makes it possible in particular to adapt the shape of the piece to the shape of the electrically conductive part of the conductive element, which do not have electrical insulation. The effect of the device is to prevent the formation of electric arcs when the connector is employed in an environment in which a plasma is capable of being created and relaxing, such as a space environment.

The piece furthermore prevents the establishment of an electric arc in any direction around the electrically conductive part stripped of electrical insulation, by virtue of the fact that the piece surrounds this electrically conductive part.

According to other characteristics of the device according to the invention, taken separately or in combination:

- the dimensions and the shape of said piece are adapted to ensure enclosure of said part having no electrical insulation in a closed compartment with a wall made of dielectric material;
- said closed compartment with a wall made of dielectric material is delimited between said piece, an electrically insulated part of said conductive element and a dielectric material wall of a connector to which said conductive element is connected;
- said closed compartment with a wall made of dielectric material is delimited between a first dielectric material wall of a connector in which said conductive element is mounted, a second dielectric material wall of a second connector for connecting with the conductive element, and said piece held between said first and second walls;
- the piece is a sleeve, which makes it possible in particular for it to be fitted around an electrical wire;
- the piece has a height at least equal to the height of the part, which has no electrical insulation, of said electrically conductive element which said piece surrounds, the height of said piece being in particular between 3 and 10 mm;
- the piece is a ring;
- the ring has in particular a diameter substantially equal to or less than half the distance separating said at least two conductive elements;
- the ring has in particular a thickness of between 0.5 and 3 mm, which corresponds to a sufficient or minimal thickness for filling the void around the conductor, that is to say eliminating direct line of sight between two conductors;
- the piece is a plate having at least two through-openings to receive each of said at least two electrically conductive elements;
- the piece is mounted in a mobile fashion around at least one of said at least two electrically conductive elements, between a first position in which said piece faces said part, which has no electrical insulation, of said electrically conductive element which it surrounds, on the one hand, and a second position in which said at least two adjacent parts, which have no electrical insulation, of said electrically conductive element face one another, on the other hand;
- the piece is held in position with respect to said electrically conductive elements which it surrounds by frangible bridges which are intended to be broken during first use and connect said piece to a component which may be next to the electrically conductive elements;
- the piece is held in position with respect to said electrically conductive element, which it surrounds, by pinching.

The invention will be understood more clearly with reference to the appended figures, in which.

Figure 1:
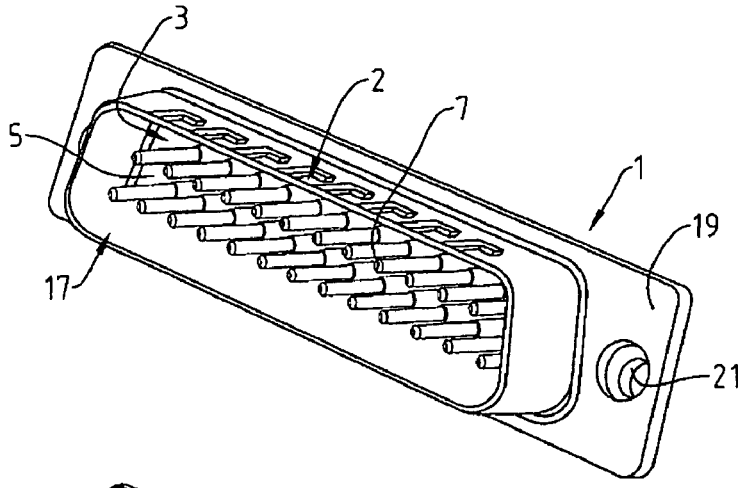
FIG. 1 is a perspective view from above of a male connector.
Figure 2:
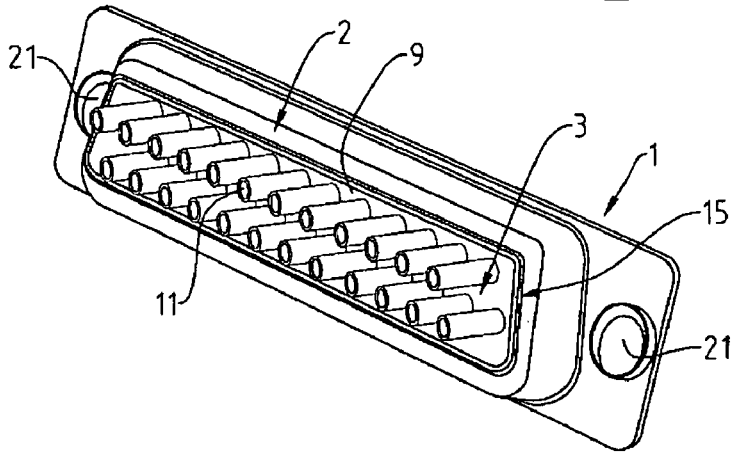
FIG. 2 is a perspective view from below of the connector in FIG. 1.
Figure 3:
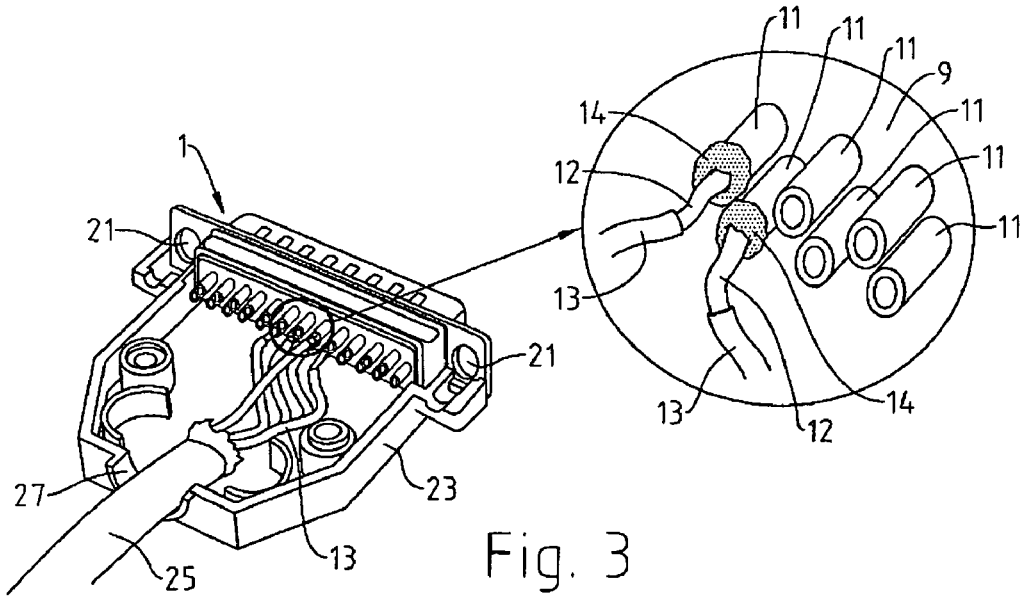
Figure 4:
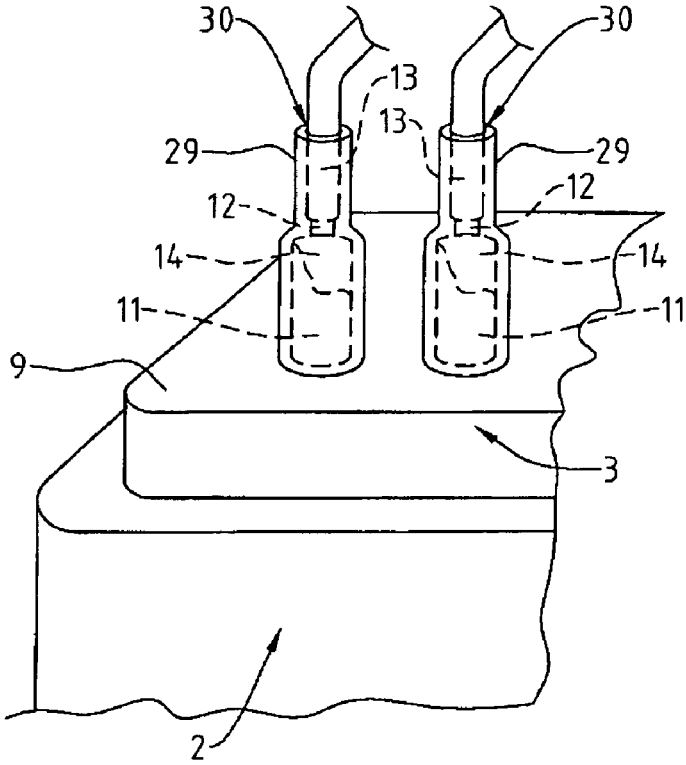
Figure 5:
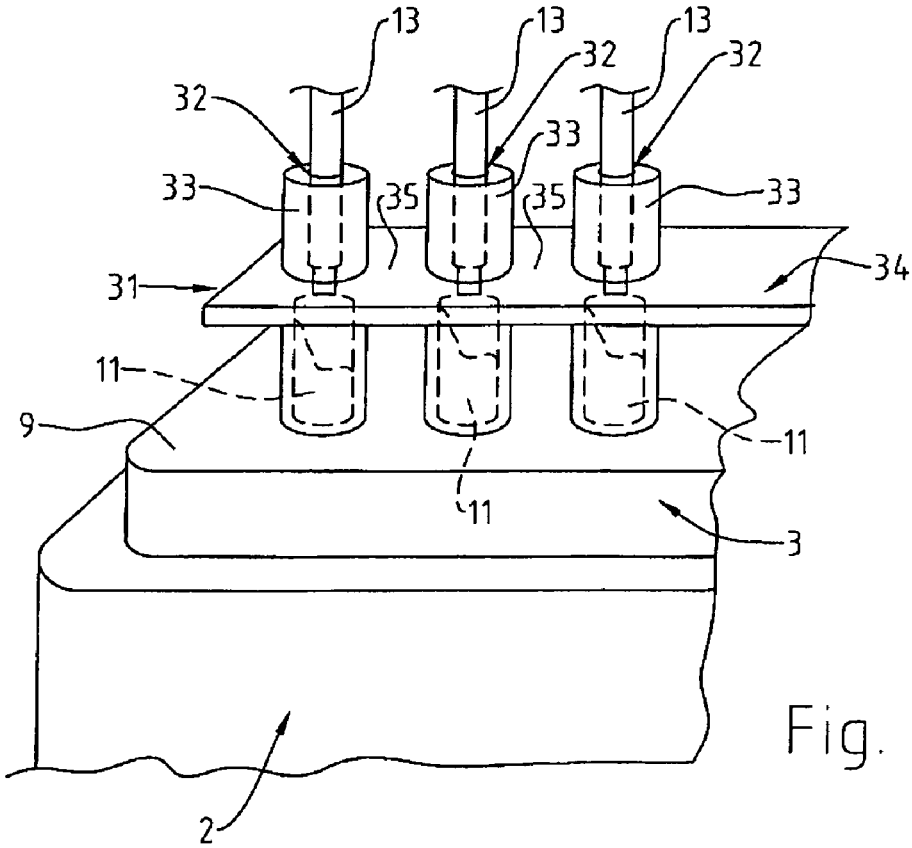
Figure 6:
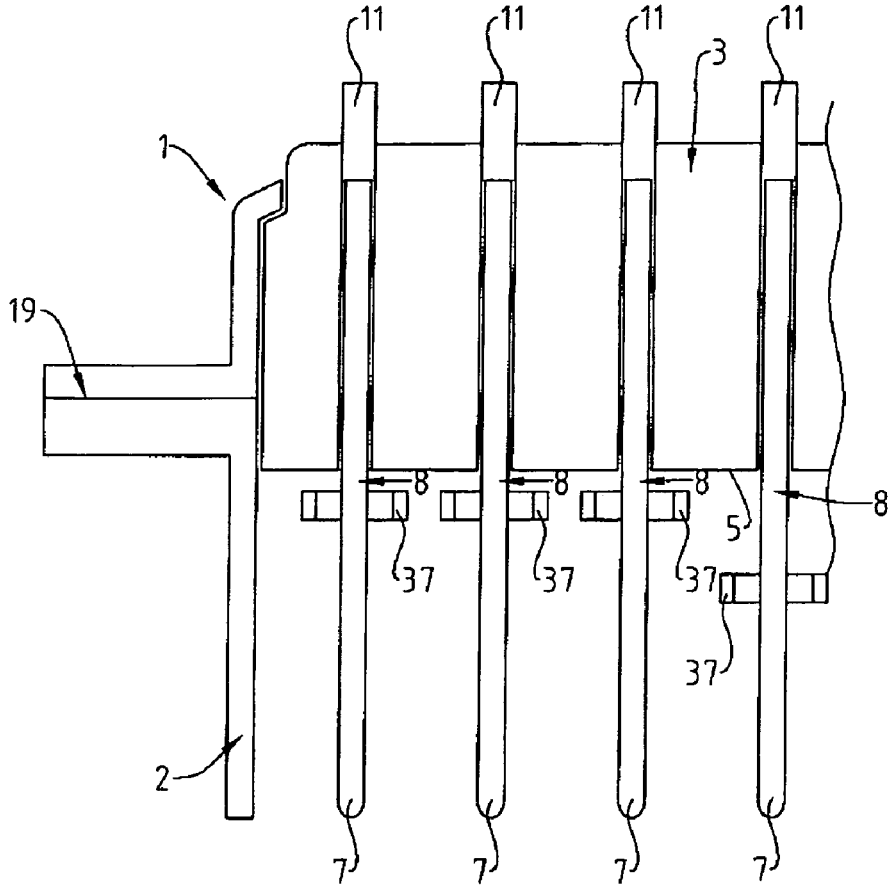
Figure 7:
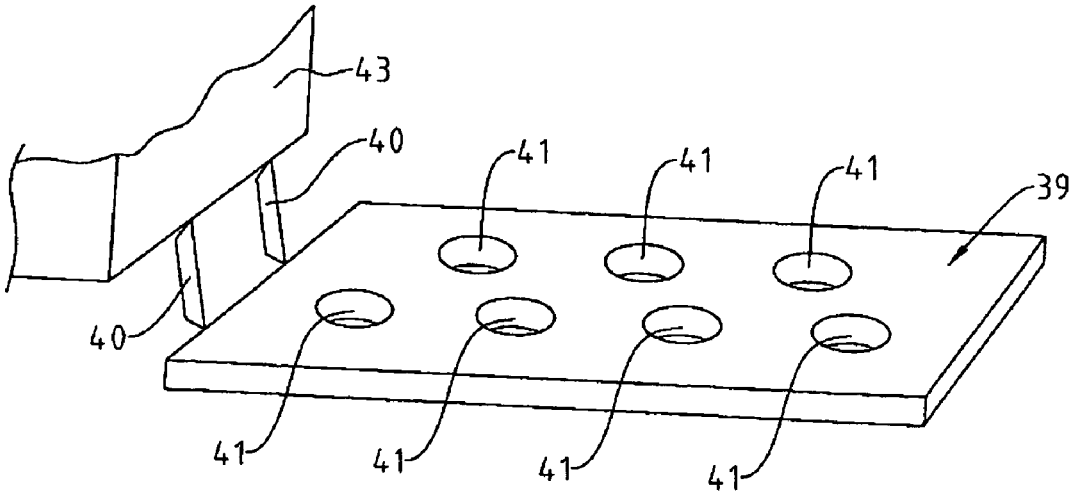

FIG. 3 is a perspective view of the connector in FIGS. 1 and 2 arranged in a housing and partially connected to an electrical cable having electrical wires, FIG. 4 is a perspective view of an electrically conductive element of the connector illustrated in FIG. 3, on which a device corresponding to a first embodiment according to the invention is employed, FIG. 5 is a perspective view of three electrically conductive elements of the connector illustrated in FIG. 3, on each of which a device corresponding to a second embodiment according to the invention is employed, FIG. 6 is a view in partial section of a connector on which a device corresponding to a third embodiment according to the invention is employed, and FIG. 7 illustrates in perspective a device corresponding to a fourth embodiment according to the invention.

First, reference will be made to FIGS. 1 to 3 in order to describe an example of an electronic component on which a device according to the invention can be employed.

Secondly, reference will be made to FIGS. 4 to 7 in order to describe various embodiments of a device according to the invention which can be employed on the optical electronic component illustrated in FIGS. 1 to 3.

FIGS. 1 to 3 show a male connector 1 capable of being employed in a space environment (where an electric arc may be established between two electrically conductive elements facing one another).

The connector 1 comprises, in a manner which is conventional per se, a housing 2 of trapezoidal cross section enclosing the connector body 3.

The connector body 3 is made of a dielectric material of the plastic material type, generally by molding.

On one of its surfaces 5, the body 3 has protruding electrically conductive connection pins 7 (FIG. 1), and on its other surface 9 protruding tubular sockets 11 which are also electrically conductive.

The tubular sockets are intended to receive stripped ends 12 of electrically conductive wires 13 in order for them to be held therein by soldering 14 (FIG. 3), for example, or by crimping according to a method known to the person skilled in the art.

Each pin 7 is connected to a tubular socket 11 in the mass of the body 3, so that each tubular housing constitutes an electrical link between an electrically conductive wire 13 and a pin 7.

In a manner which is conventional per se, the pins 7 are distributed along two rows offset from one another.

Likewise, the sockets 11 are also distributed along two rows offset from one another. They each have an opening cut in a bevel turned toward the outside of the body of the connector, in order to facilitate introduction of the stripped parts 12 of the wires 13 which are to be soldered therein (FIG. 2).

The housing 2 enclosing the body 3 has two openings 15 and 17 respectively to give passage for the tubular fixing sockets 11 and allow access to the pins 7.

Lastly, the housing 2 has a peripheral flange plate 19 comprising holes 21. The latter allow the connector to be fixed in a casing 23 which comprises the conductive wires 13 soldered to the tubular sockets 11.

The wires 13 come from a cable 25 introduced into the casing 23 through an opening 27 made in the casing.

When produced in this way, the casing 3 protects the stripped parts 12 of the wires 13 and the soldered connections 14, in particular by holding the wires 13 in position by virtue of the diameter of the opening 27, which is adjusted to the diameter of the cable 25, thus limiting the movements of the cable 25.

Reference will now be made to FIGS. 4 and 7 in order to describe several embodiments of the device according to the invention which can be employed on the connector described above.

A first embodiment is represented in FIG. 4.

In the scope of this embodiment, the device for preventing the establishment of an arc comprises a plurality of pieces 29, each made of a dielectric material.

The dielectric material is preferably a deformable plastic material.

The piece 29 is produced in the form of a sleeve fitted around the stripped part 12 of the electrical wire 13. The piece 29 thus has an opening 30 through which the electrical wire 13 passes.

The opening 30 preferably has a diameter greater than or equal to that of the electrical wires 13, so that the piece 29 can be freely displaced along the electrical wire 13.

Thus, in a first position, the piece 29 can be placed around the electrically conductive part of the wire 13 without electrical insulation, consisting of the stripped part 12, the soldered connection 14 and the tubular socket 11, while bearing against the surface 9 of the dielectric material body 3 of the connector.

In a second position, the piece 29 can be placed at a distance from this electrically conductive part of the wire 13 which has no electrical insulation, leaving the latter accessible in order, for example, to repair a defective soldered connection.

In the scope of this embodiment, the tubular piece 29 has a height such that it totally covers the tubular housing 11, the soldered connection 14, the stripped part of the wire 13 and a part of the sheath of the wire 13. The piece 29 thus entirely covers, starting from the surface 9 of the body of the connector, all the conductive parts of the elements protruding from the surface 9, which ensures optimal insulation and prevents any electric arc formation from these conductive parts.

The height of the element 29 is also more than the height of the conductive parts of the protruding elements placed end to end. By way of example, the height of the element 29 here is between 3 and 10 mm in the context of a connector in which the sockets 11 have a height substantially equal to 2.5 mm. It should, however, be understood that the heights indicated are given only as an exemplary embodiment and that the invention is not limited thereto.

The dimensions, the shape and the elastically deformable or compressible material of the piece 29 may be selected so that, once in position, this piece matches the shape of the sheathed part of the wire 13 substantially tightly, and optionally those of the stripped part 12 of the wire 13, the soldered connection 14 and the tubular socket 11 without a spacing from these elements being left, while preferably making it possible to displace and position the piece 29 along the wire 13. The tubular socket 11, the soldered connection 14 and the stripped part of the wire 13 are then fully enclosed in a closed dielectric compartment delimited by the dielectric material body 3 of the connector, the piece 29 bearing against the surface 9 of the body 3 and the sheathed part of the wire 13 held by the piece 29.

Reference will now be made to FIG. 5 in order to describe a second embodiment of a device according to the invention.

In the scope of this embodiment, the device according to the invention has a piece 31 which comprises a plate 34 consisting of a substantially rectangular wall, which is made of a flexible, elastically deformable or compressible dielectric material. On either side of the wall of which it consists, the plate 34 has tubular elements 33 forming channels.

The tubular elements 33 are materially integral with the plate 34.

The tubular elements 33 are thus connected together by bridges of material 35.

Each tubular element has a through-opening 32 into which a conductive wire 13, as well as the socket 11 in which the wire is fixed, are inserted.

In particular, the openings 33 each have an internal diameter substantially greater than the external diameter of the electrically conductive parts of the wires 13 without electrical insulation, in other words the stripped parts 12 of the conductive wires 13, the soldered connections 14 and the sockets 11.

Each tubular element 33 can thus receive an electrically conductive part, stripped of insulation, of an electrically conductive element.

The piece 31 produced in this way fills or closes off the spaces between the electrically conductive parts of the wires 13, and thus prevents the establishment of an electric arc between them.

Reference will now be made to a third embodiment of a device according to the invention, employed on the connector illustrated in FIGS. 1 to 3, and in particular on the pins 7 of the male connector 1.

Such a device providing such an effect is represented in FIG. 6.

The device comprises insulation pieces 37 produced in the form of rings from a flexible or compressible dielectric material.

The device has as many pieces 37 as the connector has pins 7. Each piece 37 is slid around a pin 7.

For a pin 7 whose length is substantially 5 mm, the rings 37 have a thickness of between 0.5 and 1 mm.

Such a thickness makes it possible to insulate a pin 7 over a height greater than that of a part 8 which will remain stripped and without electrical insulation when the pins 7 of the male connector are inserted into the correspondingly shaped reception sockets of a female connector (not shown).

The diameter of a ring 37 is substantially equal to or less than half the distance separating two contiguous pins 7.

In order to hold the rings 37 in position on the pins 7 before first use, the rings 37 are pinched around the pins 7.

The rings 37 can, however, be displaced along the pins 7 until they come to bear on the surface 5 of the body 3 under the action of a force. Particularly when the male connector is fitted into the female connector, the surface of the body of the female connector coming in contact with the rings pushes them back until they are squeezed onto the surface 5 of the body 3.

Owing to the flexible or compressible nature of the dielectric material from which they are made, the rings 37 are deformed between the surface of the body of the male connector 1 and that of the body of the female connector in their insertion position. The rings 37 thus constitute leaktight seals defining, with the dielectric material surfaces of the male and female connectors, closed dielectric compartments which insulate the conductive parts 8 of the pins 7 from one another.

The rings 37 thus prevent any establishment of arcs between the parts 8 of the pins 7 of the male connector which are not completely inserted into the female connector.

Reference will now be made to an embodiment of a device according to the invention employed on the pins 7 of a connector 1.

FIG. 7 illustrates such a variant.

The device comprises a plate 39 made of a flexible dielectric material.

The plate 39 has as many orifices 41 as the connector 1 has pins 7.

The orifices 41 are made in the plate 39 so that each can receive a pin 7. To this end, each orifice 41 has a diameter substantially greater than that of the pins 7.

The pins 7 pass through the plate 39 when it is employed on the connector 1, by insertion of the pins 7 into the orifices 41. The plate 39 is also arranged against the surface 5 of the body 3 of the connector 1.

When the pins 7 of the male connector 1 are fitted into the sockets of a female connector, the flexible plate 39 made of dielectric material is squeezed against the dielectric material surface 5 of the body 3 of the male connector 1 and the dielectric material surface of the female connector and defines, with these surfaces, closed compartments with a dielectric material wall which insulate the conductive parts 8 of the pins 7 from one another.

When the male connector is engaged with a female connector, the plate 39 thus makes it possible to fill or close off the spaces between the pins 7, so that no initiation of an electric arc is possible.

In order to ensure even better protection, the flexible dielectric material from which the plate 39 is made may be rubber or an equivalent flexible material adapted to a space environment so that, by being deformed, the plate 39 squeezed between the two surfaces of the connector bodies perfectly matches the contours of the pins 7 and the surfaces of the bodies of the two connectors between which the plate is sandwiched.

In order to facilitate positioning of the plate 39, the plate 39 is prearranged on the connector 1, that is to say the connector is equipped with a plate 39 whose holes 41 are each arranged facing a pin 7.

It should be understood that the invention is not limited to this embodiment.

The plate could directly match the shape of the male and female connectors already existing. This would make it possible merely to add the insulating element without manufacturing a specific connector.

The plate 39 is connected to an element 43 of the connector 1 by frangible bridges 40 which can be broken at the moment of engaging the male connector 1 with a female connector.

During engagement, the frangible bridges 40 are broken and the plate 39, arranged so that the pins 7 each face an orifice 41, is pressed against the surface 5 of the body 3 of the connector.

The preceding description has made it clear how the device according to the invention makes it possible to prevent the establishment of an electric arc between two mutually facing electrically conducting elements which are locally stripped of electrical insulation.

It should, however, be understood that the invention is not limited to the embodiments which have been presented above.

In fact, the invention could also for example comprise a piece made from two symmetrical half-shells. The two half-shells would be made of dielectric material. The two half-shells would be fixed together along a plane of symmetry while being attached on either side of the electrically conductive elements stripped of electrical insulation. Such an embodiment would have the advantage of making it possible to install the device according to the invention around the wires of a connector without, for example, having to remove the wires.

It should furthermore be understood that the dimensions given by way of example above are in no way limiting. For example, an insulation piece could be provided whose height is equal to the height of the conductive parts of the protruding elements placed end to end.

The invention claimed is:

1. Electrical component comprising a body made of dielectric material having at least two electrically conductive adjacent protruding sockets, and at least two electrically conductive wires which have two adjacent parts having no electrical insulation, the two adjacent parts being electrically connected and secured within two adjacent sockets, and each having extending therefrom a part with no electrical insulation, each socket securing therein the part with no electrical insulation extending from one of the at least two electrically insulated, electrically conductive wires, and a device, for preventing the establishment of an electric arc between the two adjacent parts, having at least one piece which is made of a dielectric material and has at least one through-opening for receiving at least one of the two electrically conductive wires, so as to surround at least one of the two adjacent parts, which have no electrical insulation, wherein said dielectric material from which said piece is made is elastically deformable or compressible, and the piece totally covers the at least one adjacent socket and the at least one adjacent part which has no electrical insulation.

2. Electrical component of claim 1, wherein the piece is a sleeve.

3. Electrical component of claim 2, wherein the piece has a height at least equal to the height of the part, which has no electrical insulation, of the electrically conductive wire which the piece surrounds.

4. Electrical component of claim 3, wherein the height of the piece is between 3 and 10 mm.

5. Electrical component of claim 1, wherein the piece is a ring.

6. Electrical component of claim 5, wherein the ring has a diameter substantially equal to or less than half the distance separating the at least two conductive wires.

7. Electrical component of claim 6, wherein the ring has a thickness of between 0.5 and 3 mm.

8. Electrical component of claim 1, wherein the at least one piece is a plate having at least two through-openings to receive each of the at least two electrically conductive wires.

9. The electrical component of claim 1, wherein the piece is mounted in a mobile fashion around at least one of the at least two electrically conductive wires, between a first position in which the at least one piece is placed around the part, which has no electrical insulation, of the at least one electrically conductive wire and the at least one socket, while bearing against a surface of the material dielectric body, and a second position in which the piece is placed at a distance from the part, which has no electrical insulation, of the at least one electrically conductive wire, in order to provide an access to the part.

10. The electrical component of claim 1, wherein the piece is held in position with respect to the electrically conductive wire, which it surrounds, by pinching.

11. An electrical component comprising a) a dielectric body having protruding therefrom at least two adjacent, electrically conductive sockets, b) at least two electrically conductive wires each covered with electrical insulation and each having extending therefrom a part without the electrical insulation, each of the adjacent sockets holding therein the part without the electrical insulation extending from one of the at least two electrically conductive wires, and c) a device, for preventing an electric arc between the held parts without the electrical insulation, having at least one piece made of elastically deformable or compressible dielectric material, the at least one piece having at least one through-opening receiving one of the electrically conductive wires and the held part without electrical insulation extending therefrom, such that the elastically deformable or compressible dielectric material totally covers the part without electrical insulation and the socket holding the part therein.

12. The electrical component of claim 11, wherein the at least one piece is a sleeve.

13. The electrical component of claim 11, wherein the at least one piece is a sleeve having a height at least equal to the height of the part without electrical insulation covered by the sleeve.

14. The electrical component of claim 11, wherein the at least one piece is a sleeve having a height at least equal to the height of the part without electrical insulation covered by the sleeve, wherein the height of the sleeve is between 3 and 10 mm.

15. The electrical component of claim 11, wherein the at least one piece is a ring.

16. The electrical component of claim 11, wherein the at least one piece is a ring having a diameter substantially equal to or less than half the distance separating the at least two wires.

17. The electrical component of claim 11, wherein the at least one piece is a ring having a diameter substantially equal to or less than half the distance separating the at least two wires, wherein the ring has a diameter of between 0.5 and 3 mm.

18. The electrical component of claim 11, wherein the at least one piece is a plate having at least two through-openings each receiving one of the at least two electrically conductive wires.

19. The electrical component of claim 11, wherein the at least one piece is mounted in a mobile fashion around one of the at least two electrically conductive wires between a first position in which the at least one piece (i) is placed around the secured part with no electrical insulation extending from the wire and the securing socket (ii) while bearing against a surface of the dielectric body and a second position in which the at least one piece is placed at a distance from the part with no electrical insulation extending from the wire, in order to provide access to the part.

20. The electrical component of claim 11, wherein the at least one piece is held in position with respect to the electrically conductive wire received therein by pinching.

* * * * *